US008446141B1

(12) United States Patent
McGinn

(10) Patent No.: US 8,446,141 B1
(45) Date of Patent: May 21, 2013

(54) BANDGAP CURVATURE CORRECTION CIRCUIT FOR COMPENSATING TEMPERATURE DEPENDENT BANDGAP REFERENCE SIGNAL

(75) Inventor: Michael McGinn, Tempe, AZ (US)

(73) Assignee: Maxim Integrated Products, Inc., San Jose, CA (US)

( * ) Notice: Subject to any disclaimer, the term of this patent is extended or adjusted under 35 U.S.C. 154(b) by 374 days.

(21) Appl. No.: 12/794,716

(22) Filed: Jun. 4, 2010

(51) Int. Cl.
*G05F 3/16* (2006.01)
*G05F 3/20* (2006.01)

(52) U.S. Cl.
USPC ..... 323/313; 323/315

(58) Field of Classification Search
USPC ..... 323/313
See application file for complete search history.

(56) References Cited

U.S. PATENT DOCUMENTS

| | | | | |
|---|---|---|---|---|
| 5,629,612 | A | 5/1997 | Schaffer | |
| 6,664,824 | B2 * | 12/2003 | Laws | 327/122 |
| 7,728,575 | B1 * | 6/2010 | Ozalevli et al. | 323/313 |
| 2005/0174167 | A1 * | 8/2005 | Vilander et al. | 327/560 |
| 2009/0058512 | A1 * | 3/2009 | Huang | 327/539 |
| 2009/0110027 | A1 * | 4/2009 | Chellappa | 374/178 |
| 2009/0140792 | A1 * | 6/2009 | Horie | 327/513 |

* cited by examiner

*Primary Examiner* — Adolf Berhane
*Assistant Examiner* — Emily Pham
(74) *Attorney, Agent, or Firm* — TIPS Group

(57) ABSTRACT

A temperature compensated bandgap reference circuit includes a bandgap voltage generator having a temperature dependent signal output and a correction circuit coupled to the output of the bandgap voltage generator and generating a second order quadratic signal which is complementary to the signal output.

11 Claims, 3 Drawing Sheets

BANDGAP CURVATURE CORRECTION CIRCUIT FOR COMPENSATING TEMPERATURE DEPENDENT BANDGAP REFERENCE SIGNAL

BACKGROUND

There are a number of applications in electronics which require a reference voltage. For example, digital to analog converters (DACs) require accurate reference voltages in order to properly convert digital signals to analog signals. A voltage reference circuit widely used in integrated circuits is known as a "bandgap reference circuit" and has an output voltage of around 1.25 volts with little temperature dependence. Bandgap reference circuits maintain two internal voltage sources, one of which has a positive temperature coefficient and another of which has a negative temperature coefficient. By summing the two voltage sources together the temperature dependence of the output of the bandgap reference circuit is reduced.

A common type of bandgap reference circuit known as a "Brokaw" bandgap reference circuit uses negative feedback (implemented, for example, by an operational amplifier) to force a constant current through two matched bipolar transistors with different emitter areas. The transistor with the larger emitter area requires a smaller base-voltage with the same current and the base/emitter voltage for either transistor has a negative coefficient (i.e. it decreases with temperature). Also, the difference between the two base-emitter voltages has a positive temperature coefficient (i.e. increases with temperature). The circuit produces a "proportional to absolute temperature" (PTAT) current through the series connection of a first resistor and a second resistor. When the ratio between the first and second resistors is chosen properly, the circuit's first order effects of temperature dependency will be canceled out due to the complimentary to absolute temperature (CTAT) characteristics of the base-emitter voltages of the transistors.

In the prior art, the bandgap voltage reference is "trimmed" such that the apex of the inverted parabola is at approximately room temperature (25° C.). As the operating temperature of the circuit varies from the nominal 25° C. to which the circuit is trimmed, the reference voltage produced by the circuit tends to drop. The voltage output temperature dependency of a Brokaw bandgap reference circuit typically takes the form of an inverted parabola as can be seen by the upper curve of FIG. 3.

For many electronic circuits, the temperature dependence of bandgap reference circuits such as the Brokaw bandgap reference circuit is adequate for the job. However, some electronic devices require a reference voltage which is very stable with respect to temperature. For example, some devices require a voltage reference that does not vary more than about one part per million per degree Celsius (1 PPM° C.).

The aforementioned DACs are particularly sensitive to temperature-dependent reference voltage error. This is because DACs, and especially long word (many bits) DACs require many reference voltage levels to perform their function. This tends to multiply errors because the required multiple reference voltages are typically generated by cascading bandgap reference circuits and/or by amplifying the output of a bandgap reference circuit.

Various techniques have been used to improve the temperature performance of bandgap reference circuits including piecewise linear correction of the bandgap voltage and the use or polyresistors (which have a large second order temperature coefficient) to compensate for temperature variations. However, neither of these techniques is very accurate or repeatable across manufacturing process variations, and they tend to be expensive and/or difficult to implement.

These and other limitations of the prior art will become apparent to those of skill in the art upon a reading of the following descriptions and a study of the several figures of the drawing.

SUMMARY

In an embodiment, set forth by way of example and not limitation, a bandgap curvature correction circuit includes a first bipolar transistor having a first emitter, a first base and a first collector, the first emitter being coupled to ground and a second bipolar transistor having a second emitter, a second base and a second collector, the second emitter being coupled to ground. In this example, the first collector and the second collector are coupled together. A PTAT current source and a CTAT current sink are coupled to the first base and a CTAT current source and a PTAT current sink are coupled to the second base. In this example, an output signal at the first and second collectors is a second order quadratic.

In an embodiment, set forth by way of example and not limitation, a temperature compensated bandgap reference circuit includes a bandgap voltage generator having a temperature dependent signal output and a correction circuit coupled to the output of the bandgap voltage generator and generating a second order quadratic signal which is complementary to the signal output.

In an embodiment, set forth by way of example and not limitation, a method for providing a temperature compensated bandgap voltage reference includes providing a temperature dependent bandgap reference signal and compensating the temperature dependent bandgap reference signal with a complementary compensation signal.

These and other embodiments and advantages and other features disclosed herein will become apparent to those of skill in the art upon a reading of the following descriptions and a study of the several figures of the drawing.

BRIEF DESCRIPTION OF THE DRAWINGS

Several example embodiments will now be described with reference to the drawings, wherein like components are provided with like references. The example embodiments are intended to illustrate, but not to limit. The drawings include the following figures.

DETAILED DESCRIPTION OF EXAMPLE EMBODIMENTS

Figure 1:
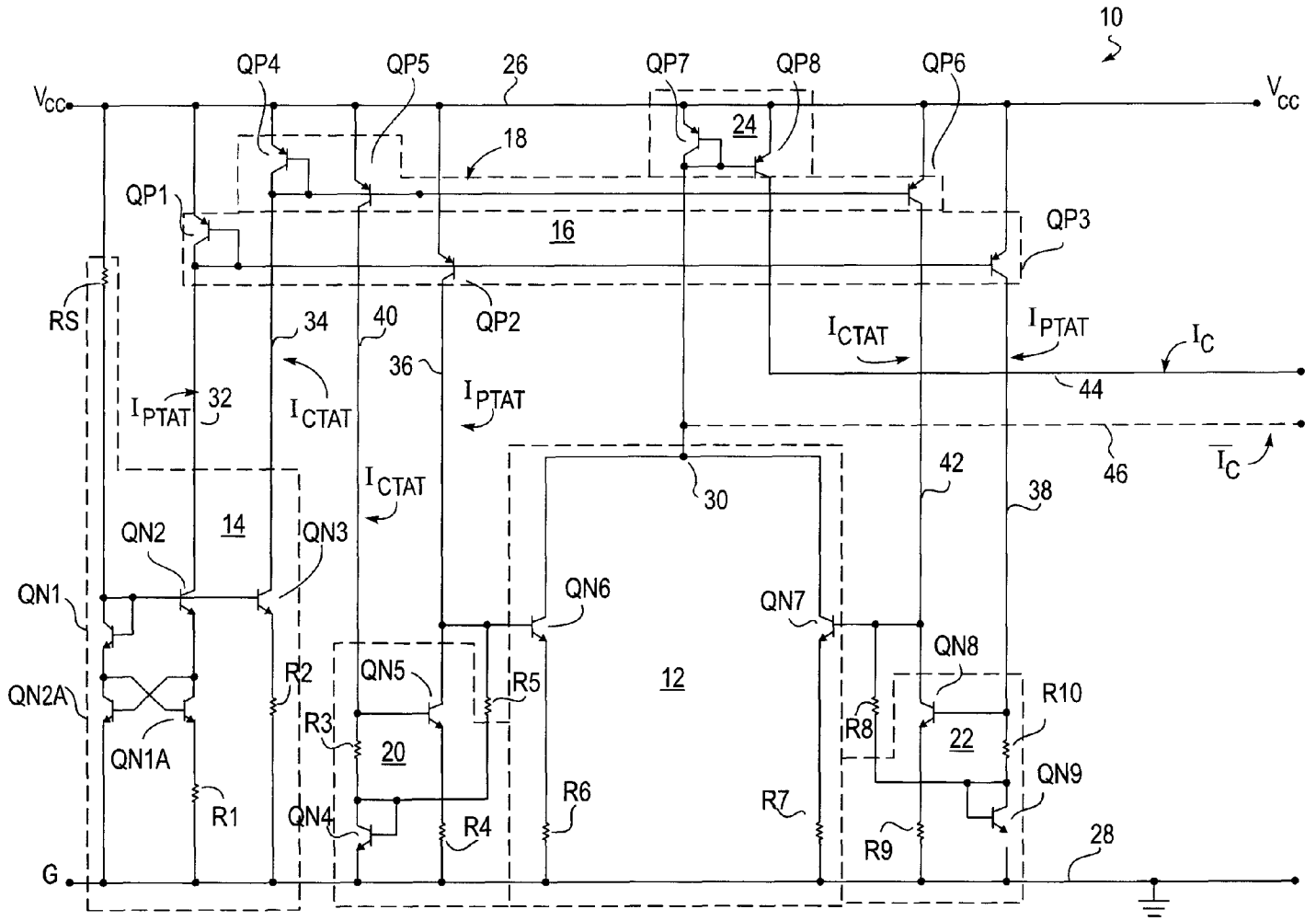
FIG. 1 is a schematic of an example bandgap curvature correction circuit.

In FIG. 1, a bandgap curvature correction circuit 10, by way of example and not limitation, includes a quadratic curve generator 12, a current generator 14, an $I_{PTAT}$ current mirror 16, an $I_{CTAT}$ current mirror 18, a CTAT current sink 20, a PTAT current sink 22 and an inverting current mirror 24. A power rail 26 is coupled to a power supply ($V_{CC}$) a and a ground rail 28 is coupled to ground (G).

Quadratic curve generator 12, by way of example and not limitation, includes a first bipolar transistor QN6 having a that emitter, a first base and a first collector. The first emitter is, in this example, coupled to ground by resistor by R6. The quadratic curve generator 12 also includes a second bipolar transistor QN7 having a second emitter, a second base and a second collector. The second emitter is, in this example, coupled to ground by a resistor R7. Also, the first and second collectors are coupled together at, for example, a node 30. In this example embodiment, first bipolar transistor QN6 and second bipolar transistor QN7 are matched NPN transistors, and resistor R6 and resistor R7 are 65 KΩ resistors.

Current generator 14, set forth by way of example and not limitation, includes NPN bipolar transistors QN1, QN2, QN3, QN1A and QN2A. The current generator 14 of this example embodiment also includes resistors R1, R2, and RS, Transistors QN1A and QN2A are cross-coupled with the base of the transistor QN1A coupled to the collector of transistor QN2A and the base of transistor QN2A coupled to the collector of transistor QN1A. The emitter of transistor QN1A is coupled to ground by resistor R1 and the emitter of transistor QN2A is coupled to ground. The emitter of transistor QN1 is coupled to the collector of transistor QN2A, the emitter of transistor QN2 is coupled to the collector of transistor of QN1A and the emitter of transistor QN3 is coupled to ground by resistor R2. The base of transistor QN1 is coupled to its collector and also to the bases of transistors Q2 and Q3. The collector of transistor QN1 is coupled to power rail 26 by resistor RS.

The example current generator 14 develops an $I_{PTAT}$ output on a line 32 and then $I_{CTAT}$ output on a line 34. By way of example and not limitation, resistor R1 can have a value of approximately 100 KΩ, resistor R2 can have a value of approximately 660 KΩ and resistor RS can have a value of 6 MΩ. It will be appreciated by those of skill in the art that there are other suitable designs for current generators such as current generator 14, $I_{PTAT}$ current mirror 16 includes, in an example embodiment, PNP transistors QP1, QP2 and QP3. The emitters of transistors QP1, QP2 and QP3 are coupled to power rail 26. The base of transistor QP1 is coupled to its collector and to the bases of transistors QP2 and QP3. The collector &transistor of QP1 is also coupled to $I_{PTAT}$ output line 32. The collectors of QP2 and QP3 comprise a plurality of $I_{PTAT}$ signals on, for example, lines 36 and 38, respectively, which are mirrors of the $I_{PTAT}$ signal on line 32. It will be appreciated by those of skill in the art that there are other suitable designs for current mirrors such as $I_{PTAT}$ current mirror 16.

$I_{CTAT}$ current mirror 18 includes PNP transistors QP4, QP5 and QP6. The emitters of transistors QP4, QP5 and QP6 are coupled to power rail 26. The base of transistor QP4 is coupled to its collector and also to the bases of transistors QP5 and QP6. The collector of transistor QP4 is coupled $I_{CTAT}$ output line 34. The collectors of transistors QP5 and QP6 comprise a plurality of $I_{CTAT}$ outputs on lines 40 and 42 which are mirrors of the $I_{CTAT}$ signal on line 34. It will be appreciated by those of skill in the art that there are other suitable designs for current mirrors such as $I_{CTAT}$ current mirror 18.

CTAT current sink 20 includes NPN transistors QN4 and QN5 and resistors R3 and R4. Resistor R5 is coupled between the base of transistor QN6 and the CTAT current sink 20 to properly bias transistor QN6. The emitter of transistor QN4 is coupled to $I_{CTAT}$ output line 40 by resistor R3 and the emitter of transistor QN4 is coupled to ground rail 28. The base of transistor QN4 is coupled to its collector. The collector of transistor QN5 is coupled to $I_{PTAT}$ output line 36 and its base is coupled to $I_{CTAT}$ output line 40. The emitter of transistor QN5 is coupled to ground rail 28 by resistor R4. The collector of transistor QN5 is also coupled to the base of transistor QN6 of the quadratic curve generator 12 and the collector of transistor QN4 is coupled to the base of transistor QN6 by resistor R5. By way of example and not limitation, resistor R3 can be approximately 150 KΩ, resistor R4 can be approximately 100 KΩ, and resistor R5 can be approximately 240 KΩ. In this example embodiment, the CTAT current sink 20 operates as a 1:1.5 current mirror.

PTAT current sink 22 includes NPN transistors QN8 and QN9 and resistors R9 and R10. Resistor R8 is coupled between the base of transistor QN7 and the PTAT current sink 22 to properly bias transistor QN7. The collector of transistor QN8 is coupled $I_{CTAT}$ output line 42 and the collector of transistor QN9 is coupled to $I_{PTAT}$ output line 38 by resistor R10. The base of transistor QN8 is coupled to $I_{PTAT}$ output line 38, and the emitter of transistor QN8 is coupled to ground rail 28 by a resistor R9. The base of transistor QN9 is coupled to its collector and to the base of transistor QN7 of quadratic curve generator 12 by resistor R8. The emitter of transistor QN9 is coupled to ground rail 28. By way of example and not limitation, resistor R8 can be approximately 240 KΩ, R9 can be approximately 100 KΩ, and R10 can be approximately 150 KΩ. In this example embodiment, the PTAT current sink 22 operates as a 1:1.5 current mirror.

Inverting current mirror 24 includes PNP transistors QP7 and QP8. The emitter of transistor QP7 is coupled to the power rail 26, and the collector of transistor QP7 is coupled to node 30 of quadratic curve generator 12. The base of transistor QP7 is coupled to its collector. The emitter of transistor QP8 is coupled to power rail 26, and its base is coupled to the base of transistor QP7. The collector of transistor QP8 provides a correction current $I_C$ on a line 44. In certain example embodiments, the $I_C$ signal on line 44 is used as a curvature correction signal.

In certain alternate embodiments, a signal $\bar{I}_C$ (which is the inverse of the signal $I_C$) can be used. This is illustrated by the broken line 46 coupled to the node 30 of the quadratic curve generator 12. That is, in certain example embodiments, the $\bar{I}_C$ signal on line 46 is used as a curvature correction signal instead of the $I_C$ signal. In such embodiments, the inverting current mirror 24 is not required and can be omitted from the circuit. In still further alternate embodiments, both the $I_C$ signal on line 44 and the $\bar{I}_C$ on line 46 can be provided. In certain of such embodiments, it is desirable that only one of the two signals should be used. Therefore, in a still further alternate embodiment, a selection apparatus, such as a MUX (not shown), can be used to select one of the two signals $\bar{I}_C$ and $I_C$.

With continuing reference to FIG. 1, the current generator 14 and current mirrors 16 and 18 of this example provide $I_{PTAT}$ currents on lines 36 and 38 which are equal to the $I_{CTAT}$ currents on lines 40 and 42 at 25° C., i.e. the temperature at which a bandgap voltage reference is typically "tuned." This is because it would be undesirable to add noise to the bandgap voltage reference at its nominal operating temperature in certain example embodiments. As temperature increases above 25° C., in this example, the $I_{PTAT}$ currents on lines 36 and 38 will increase and the $I_{CTAT}$ currents on lines 40 and 42 will decrease. The current through resistor R5 will therefore decrease and will start to turn on transistor QN6. The more the temperature rises the more transistor QN6 will be turned on. The signal developed by transistor QN6 is dependent upon its bias and the value of resistor R5. By correctly biasing transistor QN6 with the combination of the PTAT current source on line 36 and the CTAT current sink 20 a second order quadratic curve is produced as the signal of transistor QN6.

With increasing temperature, at the same time QN6 is being turned on, transistor QN7 is being further turned off because the decreasing $I_{CTAT}$ on line 42 serves to pull-down the transistor QN7. In consequence, only the current out of transistor QN6 will increase with increasing temperature. In this example embodiment, inverted compensation signal $I_C$ is the sum of the currents from the collectors of transistors QN6 and QN7 at node 30.

In this example, a decrease in temperature below 25° C. will cause the quadratic curve generator 12 to operate in a reciprocal fashion with respect to the behavior of the circuit as described above. That is as temperatures drop below 25° C. transistor QN7 begins to turn on to develop a second order quadratic curve while the transistor QN6 is being turned further off. In other examples, other exponential curves (including, but not limited to, higher order quadratic curves) can be developed by, for example, increasing the number of transistors being controlled by the $I_{PTAT}$ and $I_{CTAT}$ currents. For example, third order quadratic curves can be generated for temperature compensation or other purposes by, for example, adding transistors and summing the resultant currents.

Figure 2:
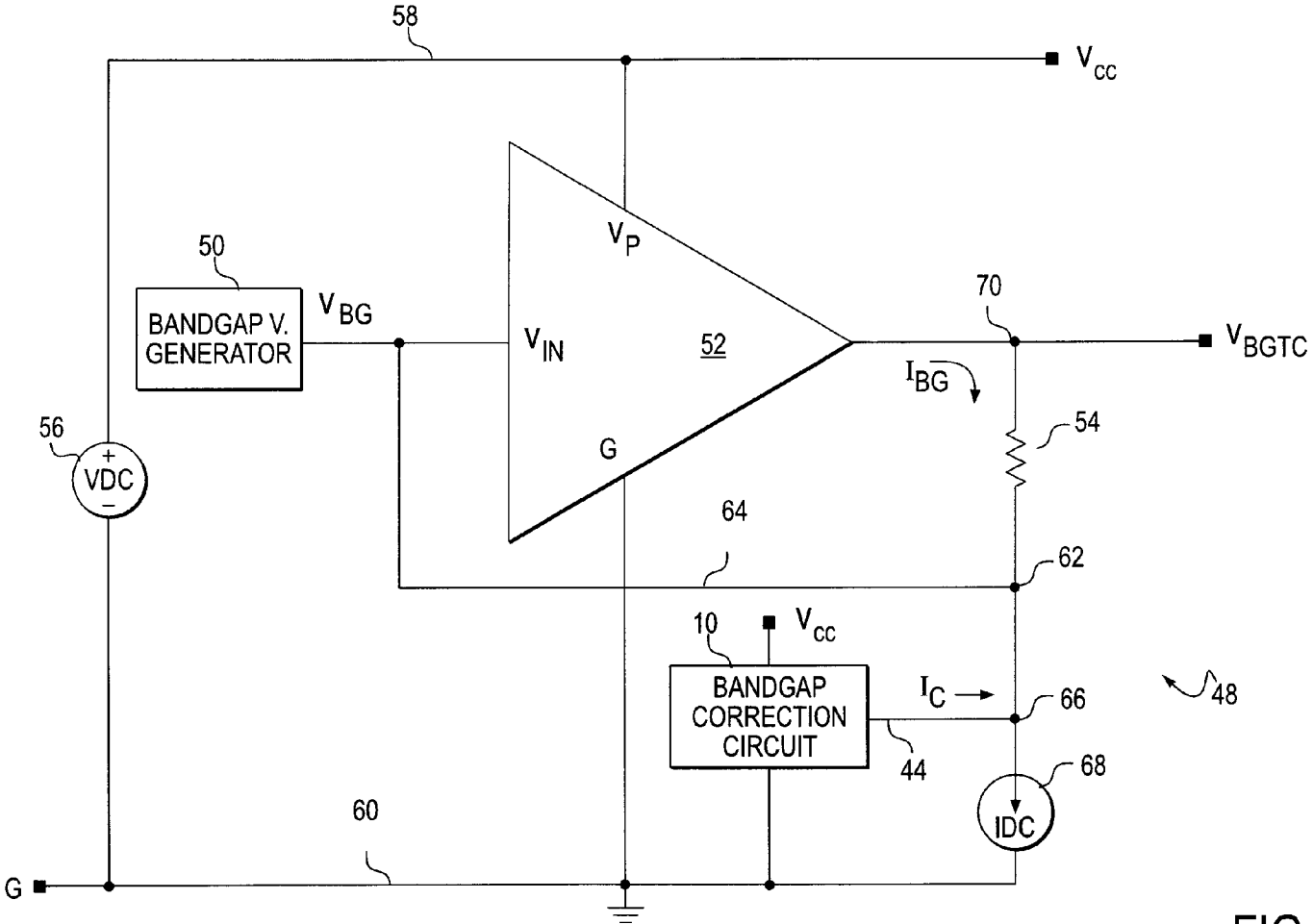
FIG. 2 is a block diagram of an example temperature compensated bandgap reference circuit.

FIG. 2 is a block diagram of an embodiment, set forth by way of example and not limitation, of a temperature compensated bandgap reference. In this figure, a temperature compensated bandgap reference circuit 48 includes a bandgap voltage generator 50, an amplifier 52, an output resistor 54 and a bandgap curvature correction circuit, such as the bandgap curvature correction circuit 10 of FIG. 2. Other bandgap reference circuits utilizing, for example, bandgap curvature correction circuit 10 can also be employed. In this example, a DC voltage source 56 is coupled between power rail 58 and ground rail 60 to provide $V_{CC}$ and ground potentials.

Bandgap voltage generator 50 can be of many conventional designs such as the aforementioned Brokaw bandgap voltage reference circuit. The typical uncompensated reference voltage $V_{BG}$ of the bandgap voltage generator 50 is in the range of 1.2 to 1.3 volts. This uncompensated reference voltage $V_{VG}$ is applied to the $V_{IN}$ input of amplifier 52. The amplifier is powered by a connection between a power input port $V_P$ and power rail 58 and is connected to ground rail 60 via a ground port G. The current which is generated by the amplifier 52 flows through output resistor 54 to ground. The voltage at a node 62 is coupled by a line 64 to the $V_{IN}$ input of the operational amplifier 52 to provide feedback stabilization. The bandgap curvature correction circuit 10 produces the correction current $I_C$ on line 44 which is summed with the current $I_{VG}$ developed by the amplifier 52 to create a total current $I_{DC}$ 68. The current flowing through resistor 54 develops, at a node 70 of the resistor, a temperature corrected bandgap voltage $V_{BGTC}$ due to the feedback provided by operational amplifier 52.

Figure 3:
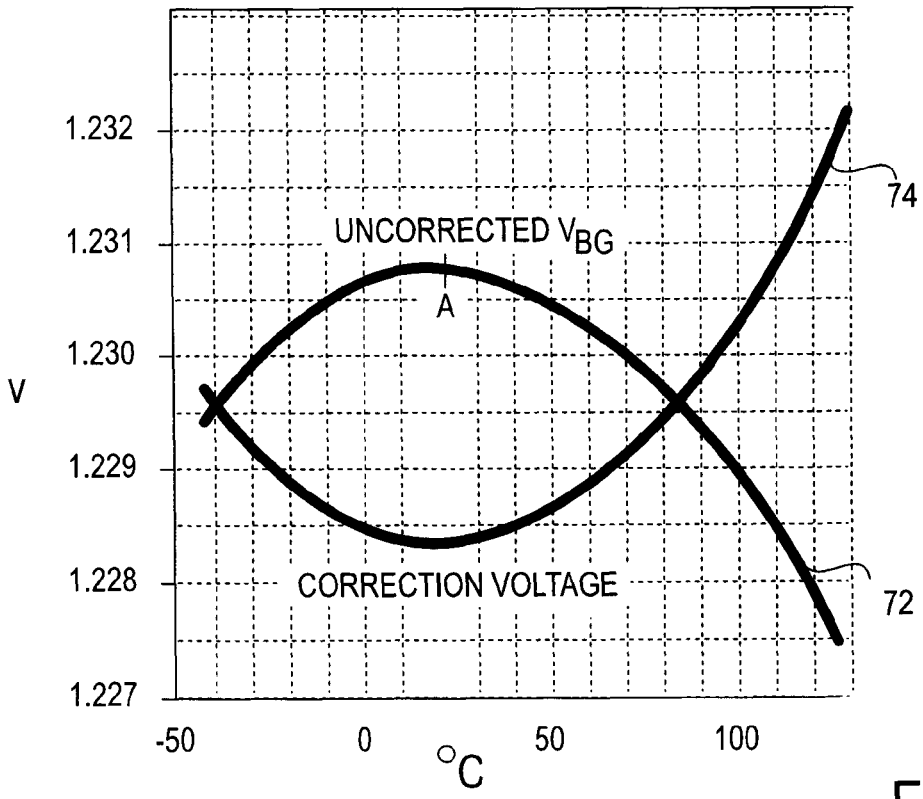
FIG. 3 is a graph illustrating a temperature dependent bandgap reference voltage and a complementary compensation voltage across a resistor of the circuit of FIG. 2.
Figure 4:
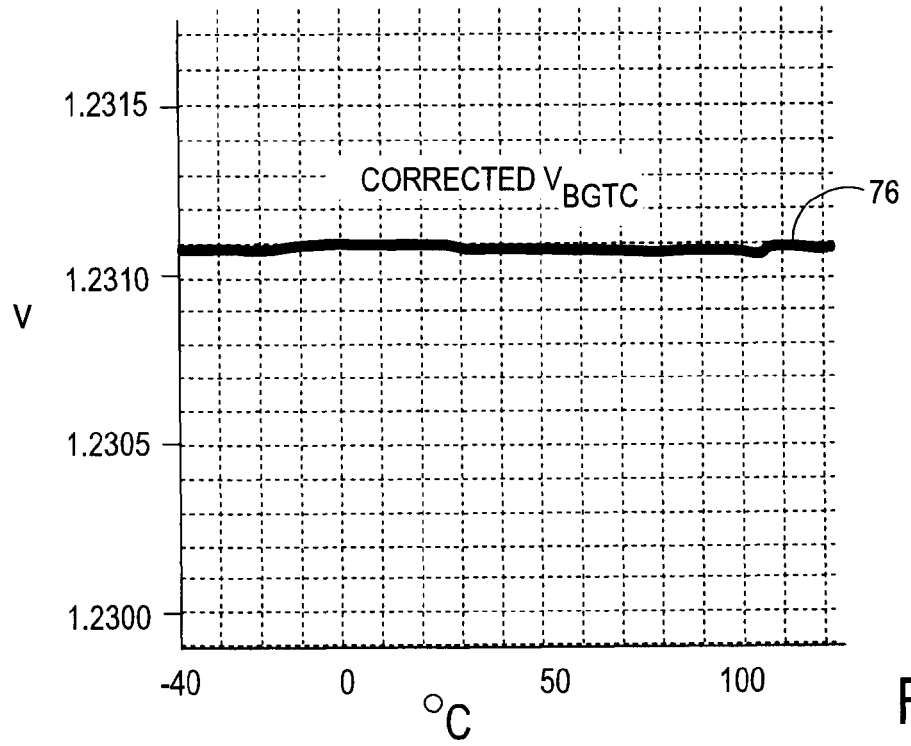
FIG. 4 is a graph illustrating a temperature compensated bandgap reference voltage formed at the output of the circuit of FIG. 2.

The graph of FIG. 3 illustrates two curves: an uncorrected bandgap voltage signal developed by a bandgap voltage reference and a correction voltage signal developed by a bandgap curvature correction circuit such as that illustrated in FIG. 1. As seen in FIG. 3, the uncorrected bandgap voltage $V_{GB}$ is a function of temperature and takes the form of an inverted parabola having an apex A at approximately 20-25° C. The correction voltage 74 caused by the correction current $I_C$ flowing through, for example, resistor 54 of FIG. 2 is, in this example embodiment, a second order quadratic designed to be complementary to the amplified $V_{VG}$ signal. When the voltage curves 72 and 74 are added together to create a corrected voltage $V_{BGTC}$, the reference Output voltage is substantially constant over a broad range of temperatures. The sum of the voltage curves 72 and 74 of FIG. 3 is the corrected $V_{BGTC}$ curve 76 in FIG. 4 which is accurate to at least 1 PPM° C.

As used herein, the term "signal" can refer at various times to, for example, voltage and current signals. It will be appreciated by those skilled in the art that voltage signals can be converted to current signals and current signals can be converted to voltage signals via active or passive components, such as resistors. Furthermore, although various embodiments have been described using specific terms and devices, such description is for illustrative purposes only. The words used are words of description rather than of limitation. It is to be understood that changes and variations may be made by those of ordinary skill in the art without departing from the spirit or the scope of various embodiments. In addition, it should be understood that aspects of various other embodiments may be interchanged either in whole or in part. It is therefore intended that the claims be interpreted in accordance with the true spirit and scope of the inventions disclosed herein without limitation or estoppel.

What is claimed is:

1. A bandgap curvature correction circuit comprising:

a first bipolar transistor having a first emitter, a first base and a first collector, said first emitter being coupled to ground;

a second bipolar transistor having a second emitter, a second base and a second collector, said second emitter being coupled to ground, and wherein said first collector and said second collector are coupled together;

a PTAT current source and a CTAT current sink coupled to said first base;

a CTAT current source and a PTAT current sink coupled to said second base;

current generator operative to develop an $I_{PTAT}$ output and an $I_{CTAT}$ output; and a $I_{PTAT}$ current mirror having an input coupled to said $I_{PTAT}$ output and having a plurality of $I_{PTAT}$ outputs and an $I_{CTAT}$ current mirror coupled to said $I_{CTAT}$ output and having a plurality of $I_{CTAT}$ outputs;

wherein a first $I_{PTAT}$ output of said $I_{PTAT}$ current mirror is coupled to said first base;

whereby an output signal at said first and second collectors is second order quadratic.

2. A bandgap curvature correction circuit as recited in claim 1 wherein said first emitter and said second emitter are coupled to ground by at least one resistor.

3. A bandgap curvature correction circuit as recited in claim 1 wherein said CTAT current sink is coupled to said first base and to a first $I_{CTAT}$ output of said $I_{CTAT}$ current mirror.

4. A bandgap curvature correction circuit comprising:

a first bipolar transistor having a first emitter, a first base and a first collector, said first emitter being coupled to ground;

a second bipolar transistor having a second emitter, a second base and a second collector, said second emitter being coupled to ground, and wherein said first collector and said second collector are coupled together;

a PTAT current source and a CTAT current sink coupled to said first base;

a CTAT current source and a PTAT current sink coupled to said second base;

current generator operative to develop an $I_{PTAT}$ output and an $I_{CTAT}$ output; and a $I_{PTAT}$ current mirror having an input coupled to said $I_{PTAT}$ output and having a plurality of $I_{PTAT}$ outputs and an $I_{CTAT}$ current mirror coupled to said $I_{CTAT}$ output and having a plurality of $I_{CTAT}$ outputs;

wherein a second $I_{CTAT}$ output of said $I_{CTAT}$ current mirror is coupled to said second base;

whereby an output signal at said first and second collectors is second order quadratic.

5. A bandgap curvature correction circuit as recited in claim 4 wherein said PTAT current sink is coupled to said second base and to a second $I_{PTAT}$ output of said $I_{PTAT}$ current mirror.

6. A bandgap curvature correction circuit as recited in claim 4 wherein said first emitter and said second emitter are coupled to ground by at least one resistor.

7. A bandgap curvature correction circuit comprising:

a first bipolar transistor having a first emitter, a first base and a first collector, said first emitter being coupled to ground;

a second bipolar transistor having a second emitter, a second base and a second collector, said second emitter being coupled to ground, and wherein said first collector and said second collector are coupled together;

a PTAT current source and a CTAT current sink coupled to said first base; and a CTAT current source and a PTAT current sink coupled to said second base; and an inverting current mirror having an input coupled to said first and second collectors and an output comprising a correction current $I_C$;

whereby an output signal at said first and second collectors is second order quadratic.

8. A temperature compensated bandgap reference circuit comprising:

a bandgap voltage generator having a temperature dependent signal output; and a correction circuit coupled to said output of said bandgap voltage generator and generating a second order quadratic signal which is complementary to said signal output, whereby a temperature compensated bandgap reference signal is produced, said correction circuit including:

a first bipolar transistor having a first emitter, a first base and a first collector, said first emitter being coupled to ground;

a second bipolar transistor having a second emitter, a second base and a second collector, said second emitter being coupled to ground, and wherein said first collector and said second collector are coupled together;

a PTAT current source and a CTAT current sink coupled to said first base;

a CTAT current source and a PTAT current sink coupled to said second base;

a current generator operative to develop an $I_{PTAT}$ output and an $I_{CTAT}$ output; and a $I_{PTAT}$ current mirror having an input coupled to said $I_{PTAT}$ output and having a plurality of $I_{PTAT}$ outputs and an $I_{CTAT}$ current mirror coupled to said $I_{CTAT}$ output and having a plurality of $I_{CTAT}$ outputs;

wherein a first $I_{PTAT}$ output of said $I_{PTAT}$ current mirror is coupled to said first base, said CTAT current sink is coupled to said first base and to a first $I_{CTAT}$ output of said $I_{CTAT}$ current mirror, a second $I_{CTAT}$ output of said $I_{CTAT}$ current mirror is coupled to said second base and said PTAT current sink is coupled to said second base and to a second $I_{PTAT}$ output of said $I_{PTAT}$ current mirror.

9. A temperature correction circuit as recited in claim 8 further comprising an inverting current mirror having an input coupled to said first and second collectors and an output comprising a correction current $I_C$.

10. A temperature compensated bandgap reference circuit as recited in claim 8 further comprising an amplifier having an input coupled to said signal output of said bandgap voltage generator, an output operative to develop a compensated bandgap reference signal and a feedback path between said output and said input of said amplifier.

11. A temperature compensated bandgap reference circuit as recited in claim 10 wherein said correction circuit is coupled to said output of said amplifier.

* * * * *